United States Patent [19]

Threeton, Sr.

[11] 3,961,734

[45] June 8, 1976

[54] SUIT CARRIER HANDLE

[75] Inventor: Clay L. Threeton, Sr., Atlanta, Ga.

[73] Assignee: The Raymond Lee Organization, Inc., New York, N.Y. ; a part interest

[22] Filed: Aug. 13, 1974

[21] Appl. No.: 496,982

[52] U.S. Cl. ..... 224/45 T; 223/85

[51] Int. Cl.[2] ..... A45C 71/00

[58] Field of Search ..... 224/45 T, 45 N, 45 S, 224/42.1 CA; 206/7 R; 223/85; 24/87 R, 13

[56] References Cited

UNITED STATES PATENTS

| | | | |
|---|---|---|---|
| 2,769,587 | 11/1956 | Threeton | 224/45 X |
| 3,362,599 | 1/1968 | Galazin | 224/45 X |
| 3,554,418 | 1/1971 | Holmes | 224/45 X |
| 3,675,834 | 7/1972 | Peters | 224/45 X |
| 3,744,600 | 7/1973 | Belland et al. | 224/45 X |

*Primary Examiner*—Albert J. Makay
*Assistant Examiner*—Kenneth Noland
*Attorney, Agent, or Firm*—Howard I. Podell

[57] ABSTRACT

A convenient handle for carrying or for hanging one, two or more conventional wooden suit hangers supporting suits, coats, dresses or draperies during transit. The device permits the garments being carried to be protected by an auxiliary sheath or bag. The device is shaped with an upper section in the form of a hooklike carrying handle, while the lower portion is mounted with means for attaching one or more clothes hangers. The upper handle section is shaped to fit over a conventional horizontal closet pole.

4 Claims, 2 Drawing Figures

SUIT CARRIER HANDLE

SUMMARY OF THE INVENTION

This invention relates to a device for hand carrying or suspending one or more garments mounted on conventional clothes hangers and particularly to a device which may be utilized for transporting garments.

An advantage of this device is that it is fitted with a handle for manual use which is shaped to also fit over a conventional horizontal closet pole.

BRIEF DESCRIPTION OF THE DRAWING

The objects and features of the invention may be understood with reference to the following detailed description of an illustrative embodiment of the invention, taken together with the accompanying drawings in which.

Figure 1:
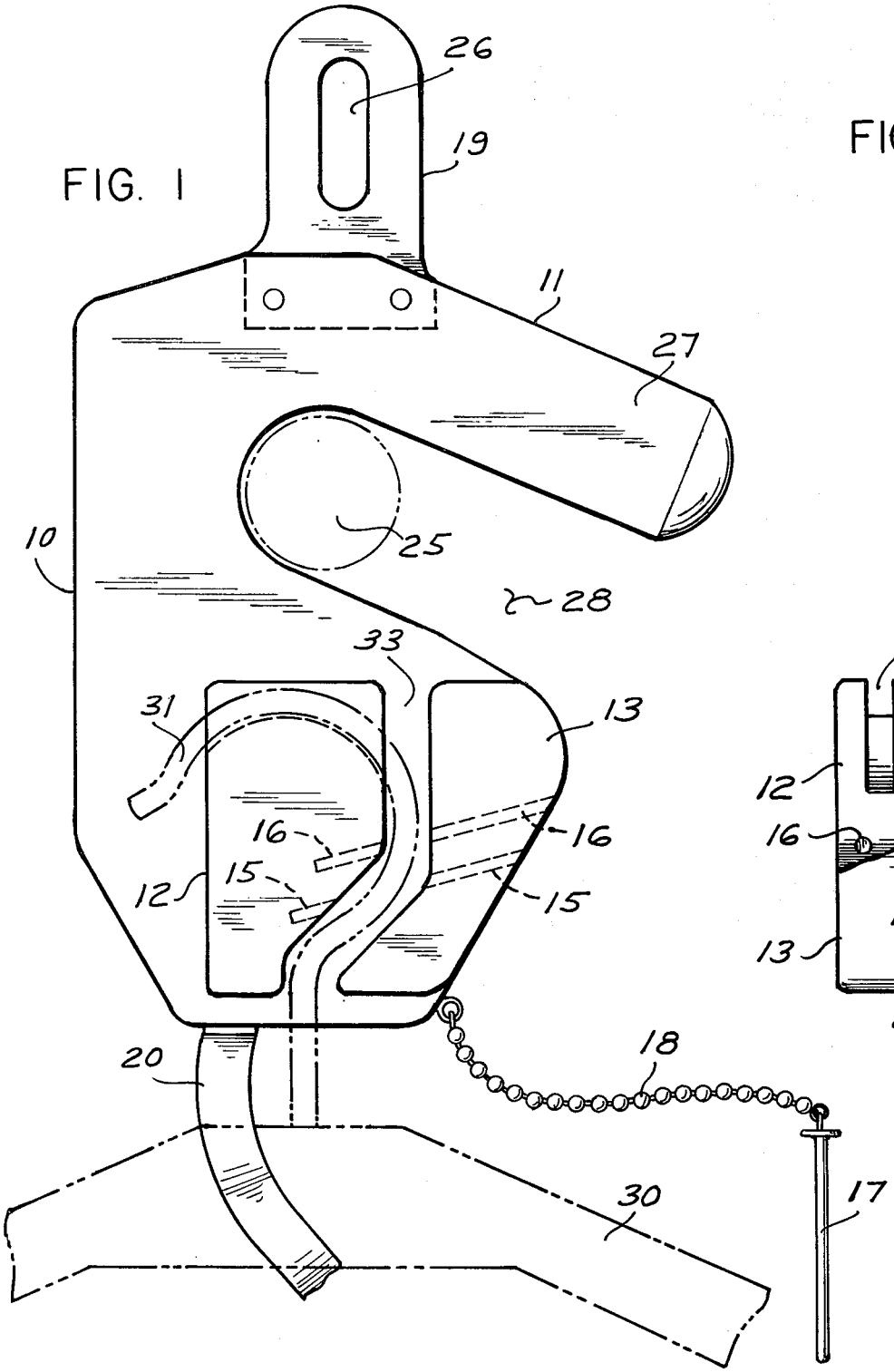
FIG. 1 is an elevation view of the device.
Figure 2:
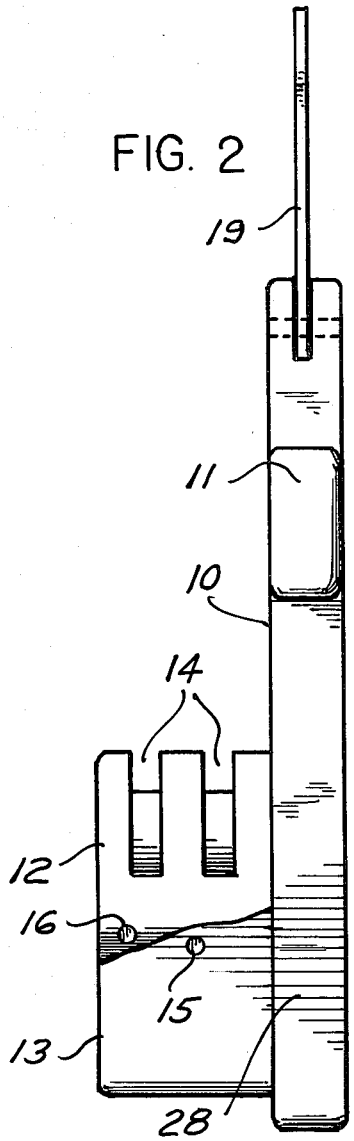
FIG. 2 is a side view of the device.

DESCRIPTION OF THE PREFERRED EMBODIMENT:

Turning now descriptively to the drawings, in which similar reference characters denote similar elements throughout the several views, FIGS. 1–2 show the carrying device 10 which is shaped to support one or more conventional wooden clothes hangers 30 on which garments may be mounted and is fitted with a handle 11 shaped to be readily manually grasped or alternately to be hung over a horizontal closet pole 25. A tab 19 is formed with a slot 26 of a size to fit over a conventional clothes hook fixed to a wall or an automobile.

The handle section 11 is formed of a projecting member 27 that is spaced from the body of the device by a parallel wall open slot 28, with the axis of slot 28 oriented at an angle to the vertical axis of the device 10, and of a size to readily slip over a closet pole 25 for suspension of the device.

A side member 12 projects from one or both sides of the lower portion 28 of the device, with one or more indented open slots 14 formed in the top of side member 12 of a size to each suspend the hook 31 of a conventional wooden clothes hanger 30. An additional side member 13 is located a spaced distance from side member 12 to provide vertical groove 33 of greater width than the thickness of a clothes hanger hook 31, with groove 33 shaped to clear the sides of a hook 31 of a clothes hanger resting in a groove 14 of the side member 12. Through holes 15 and 16 are oriented transversely through side member 13 and partially continued through side member 12 so that a latch pin 17 inserted into a hole 15 or 16 prevents sidewise movement of a clothes hanger hook 31 resting in a groove 14 of side member 12. Latch pin 17 may be fastened by a bead chain 18 to the body of the device for retention purposes.

Since obvious changes may be made in the specific embodiment of the invention described herein, such modifications being within the spirit and scope of the invention claimed, it is indicated that all matter contained herein is intended as illustrative and not as limiting in scope.

I claim:

1. A device for use in manual carrying, or alternately, storing in suspension, one or more clothes hangers on which garments may be hung, said device fitted with a carrying handle, a first end of which is fastened to a projection extending from the body of the device, said projection of a length to space the handle member from the body of the device by a distance of the diameter of a conventional horizontal closet pole to permit slipping the handle over a conventional horizontal closet pole said handle member extending downwards at an acute angle to the horizontal plane from the said first end, when the device hangs freely from the handle member on a horizontal closet pole so that the second and free end of the handle extends below the top of the closet pole supporting the handle member, said angular orientation of the handle member also enabling a person to comfortably grip the handle member when carrying the device with lengthy items of clothing hung from a clothes hanger suspended from the device, in which the body of the device is fitted with a first and a second shaped section, each section projecting from the same side of the said body, with said sections separated from each other by a substantially hooked shaped slot of a size to loosely fit about the neck of a clothes hanger hook, the top of which hook is hanging over the first said section, said first said section being shaped to fit within the hook of a clothes hanger which is supported by the said first shaped section.

2. The combination as recited in claim 1 in which the top of the first shaped section is formed with recesses separated by walls, with the walls bounding each recess of a size to fit about the top of a clothes hanger hook resting in the bounded recess.

3. The combination as recited in claim 2 in which a through hole is formed through the second section that is aligned with a hole in the first section, the axis of said holes being parallel to the external surface of the body of the device that adjoins the slot between the first and section sections, together with a pin that freely fits into both holes, said hole axis being spaced apart from the said external body surface by a distance, such that with a clothes hanger hung from the first section and adjacent to the said external body surface and with the shank of the clothes hanger hook lying in the said slot, the pin may be inserted in said holes to freely pass about the external side of shank of the hook section of said clothes hanger and enclose the said shank between the pin and the external body surface.

4. The combination as recited in claim 3 together with an additional set of similar holes in the first member and second member, said additional set of holes located adjacent the external surfaces of the first and second sections for latching a plurality of coat hanger hooks suspended from the first section with the pin inserted into said additional set of holes.

* * * * *